US006854523B2

(12) United States Patent
Takahashi

(10) Patent No.: US 6,854,523 B2
(45) Date of Patent: Feb. 15, 2005

(54) WORKING VEHICLE

(75) Inventor: Hitoshi Takahashi, Oyama (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 10/407,044

(22) Filed: Apr. 4, 2003

(65) Prior Publication Data

US 2003/0221845 A1 Dec. 4, 2003

(30) Foreign Application Priority Data

May 28, 2002 (JP) ..... 2002-153620

(51) Int. Cl.[7] ..... E02F 5/00; F02M 3/00

(52) U.S. Cl. ..... 172/3; 37/382; 123/339.1; 123/339.16

(58) Field of Search ..... 123/339.16, 339.19, 123/339.21, 339.1; 37/381, 382; 701/50; 172/2, 3, 297, 381, 382

(56) References Cited

U.S. PATENT DOCUMENTS 4,616,615 A * 10/1986 Kawaguchi et al. ... 123/339.15
4,709,334 A * 11/1987 Abe et al. ..... 701/104
5,477,679 A * 12/1995 Tatsumi et al. ..... 60/431
5,574,643 A * 11/1996 Yesel ..... 701/88
5,587,905 A * 12/1996 Yesel et al. ..... 701/53
5,682,855 A * 11/1997 Lee et al. ..... 123/352
5,863,277 A * 1/1999 Melbourne ..... 477/203
5,878,721 A * 3/1999 Nakamura ..... 123/496
5,911,506 A * 6/1999 Nakamura et al. ..... 37/348
6,020,651 A * 2/2000 Nakamura et al. ..... 290/40 R
6,220,218 B1 * 4/2001 Saiki ..... 123/339.19
6,308,698 B1 * 10/2001 Shioi et al. ..... 123/680
6,352,491 B2 * 3/2002 Mashiki et al. ..... 477/107
6,415,766 B1 * 7/2002 Kanno et al. ..... 123/339.19
6,470,854 B1 * 10/2002 Hirata et al. ..... 123/436
6,574,535 B1 * 6/2003 Morris et al. ..... 701/22
6,629,407 B2 * 10/2003 Roos et al. ..... 60/274

FOREIGN PATENT DOCUMENTS

JP 04353241 * 12/1992

* cited by examiner

*Primary Examiner*—Robert E. Pezzuto
*Assistant Examiner*—Nathan S Mammen
(74) *Attorney, Agent, or Firm*—Frishauf, Holtz, Goodman & Chick, P.C.

(57) ABSTRACT

In a motor grader, controls for running the vehicle at a constant speed are provided when a work for improving a land surface with a blade is started by running a working vehicle at a low speed from the low idling start. With this operation, it is possible to perform the work for improving a land surface by maintaining an actual revolution speed of the engine 5 at a value obtained by subtracting a prespecified revolution speed from the revolution speed for low idling to run the working vehicle at a low speed. With this feature, it is possible to continue the work at a constant speed and also to prevent occurrence of engine stop during the work at a low speed, when a higher duty of the engine is required and the actual revolution speed drops like in the case where an ascending slope of the land to be improved becomes large or where the cutting rate temporally increases due to local irregularities of the land surface during the land surface improvement work.

7 Claims, 3 Drawing Sheets

WORKING VEHICLE

BACKGROUND OF THE INVENTION

1. Field of the Invention

The present invention relates to a working vehicle, and more specifically to a working vehicle which performs works at a low speed such as a motor grader.

2. Description of Related Art

There has been known the technique of improving a surface of a road or a ground by cutting or smoothing it to a flat state with a motor grader as one of a number of working vehicles (including earth-moving machines or construction machines). The land-improving work with the motor grader is performed mainly with a blade as a working machine, and high precision is required in this work, so that the vehicle's speed is kept low so that the works can be carried out carefully.

In the motor grader, the rear wheels are driven by a diesel engine via a torque converter and a transmission (with a tandem device), and when the motor grader is applied to the land-improving work, the revolution speed of the engine is dropped to a level near that at which the engine stops (the so-called engine-stopped state) and is driven at a low revolution speed of the engine. In the motor grader engine, it is possible like in other types of working vehicles to select either the low idling mode in which a revolution speed of the engine in the idling state is kept low or the high idling mode in which the revolution speed of the engine is kept high, and the land-improving work at the low revolution speed of the engine is inevitably performed in the low idling mode.

When a higher duty of the engine is required to respond to a larger ascending slope of a land to be improved or to a temporal increase of the land-cutting rate caused by local irregularities, the speed of the vehicle becomes further slower, and also a revolution speed of the engine drops with the engine stop easily occurring. When the event as described occurs, the operator operates an accelerator to raise a revolution speed of the engine for maintaining the speed, but in this situation the operator concentrate his or her mind on grasping a form of the land to be improved or on operation of a blade, so that the operator can not operate the accelerator smoothly, and therefore engine stop frequently occurs.

Once the engine stop occurs, the vehicle stops once, and also the work for improving the land surface with a blade is stopped once, so that a step caused by operation stop of the blade is generated on the surface of the improved land, which makes it difficult to improve the land surface with the expected precision. If this event occurs, sometimes it is required to restart the work for improving the land surface from the initial stage, which is troublesome. Especially when the engine stop occurs in the finishing stage of the work for improving the land surface, if only the stepped section is again improved, finishing with high precision is impossible, and the work for re-finishing must be performed repeatedly in a wide area around the stepped section, which substantially spoils the work efficiency.

On the other hand, when a large capacity engine capable of generating a large low speed torque even during running at a low speed is used, the engine stop never occurs even when a higher duty is required for the engine, and the work for improving the land surface can be carried out continuously. However, the large capacity engine as described above requires a large space for mounting it on a vehicle, so that also the size of the vehicle is required to be large and also the cost becomes higher. Recently there is the tendency for suppressing the low speed torque to the same level as that for a small capacity engine to satisfy the emission control requirements becoming more and more strict, and there is the need for efficiently preventing occurrence of the engine stop with the engine having the low speed torque as described above.

SUMMARY OF THE INVENTION

A main purpose of the present invention is to provide a working vehicle in which the running speed can be controlled at a constant level in the low speed area and occurrence of engine stop can effectively be prevented.

The working vehicle according to the present invention is one capable of performed required works at a low running speed, and comprises an engine used as a driving force source for running; a fuel injection pump for feeding an injected fuel to the engine; a fuel injection rate control unit for controlling a feed rate of the injected fuel from the fuel injection pump to the engine; a revolution speed detector for detecting an actual revolution speed of the engine; and a controller for controlling a revolution speed of the engine to a target revolution speed according to the actual revolution speed of the engine detected by the revolution speed detector to adjust a running speed of the vehicle, and further the working vehicle is characterized in that the controller comprises a revolution speed comparator for comparing the actual revolution speed to the target revolution speed and an injection rate signal output unit for outputting an injection rate signal corresponding to a result of the comparison with the revolution speed comparator to the injection rate control unit, and further in that the target revolution speed can be set to a value at least lower than the revolution speed in the low speed area for idling at which the engine does not go down.

With this configuration, by setting a revolution speed further lower as compared to the revolution speed of an engine in the low speed area for idling (low idling) as a target revolution speed and feeding back the actual revolution speed of the engine to the controller, a fuel injection rate to the engine can automatically be controlled so that the actual revolution speed matches the target revolution speed. Because of this feature, an injected fuel is fed so that the revolution speed of the engine is always kept low and also the running speed of the vehicle is kept at a constant and low level (for controlling the running speed of the vehicle at a constant level). Further, even if an actual revolution speed further drops in association with increase of duty to a value near that at which engine stop occurs, the fuel injection rate is controlled and decided so that the dropped actual revolution speed returns to the target revolution speed, and therefore a torque sufficient for satisfying the requirement for the higher rate is generated with occurrence of engine stop efficiently prevented. Thus the object of the present invention is achieved.

In the present invention, it is required only that the target revolution speed of an engine can be set to a value lower than a revolution speed in the low speed area for idling at which the engine does not stop. In addition, the configuration in which the target revolution speed can be set to a value higher than the revolution speed in the low speed area for idling is also included within the scope of the present invention.

The target revolution speed is required only to be within the conventionally allowable error range, and is not limited to a value strictly defined.

The working vehicle according to the present invention comprises a target revolution speed setting unit for calculating and setting the target revolution speed according to an actual revolution speed detected by the revolution speed detecting unit, and this revolution speed setting unit preferably sets, When the actual revolution speed is the same as the revolution speed in the low speed area for idling, a value lower by a prespecified revolution speed than the actual revolution speed as the target revolution speed, and also sets, when the actual revolution speed is higher than the revolution speed in the low speed area for idling, a value of the actual revolution speed as the target revolution speed.

With this configuration, when the working vehicle according to the present invention is now in the idling state and is required to again start running for resuming the work, it is required only to activate the target revolution speed setting unit prior to start of the work. With this operation, the target revolution speed is automatically set to a value lower than the revolution speed in the low speed area for idling, and then the subsequent work can be carried out continuously running at a low speed without causing engine stop.

Further, as a revolution speed in the low speed for idling of an engine varies according to types of engines or to other factors, it is required to previously set the target revolution speed according to a type of an engine, which requires a long period of time. With the present invention, however, when it is determined that the actual revolution speed is the same as the revolution speed in the low speed area for idling like during low idling, the target revolution speed is automatically calculated by the target revolution speed setting unit, so that it is not required to previously set the target revolution speed specific to each of the engine types, which makes it possible to reduce the time required for setting.

On the other hand, when the engine is running at a revolution speed higher than that for low idling, or, for instance, when the working vehicle is running without the working machine operated, the actual revolution speed at which the vehicle is running is as it is as the target revolution speed only by operating the target revolution speed setting unit, so that the vehicle can run at a constant speed without operating the accelerator.

The working vehicle according to the present invention preferably comprises a control start condition determining unit for determining whether the conditions for starting controls with the controller are satisfied or not.

Further the working vehicle according to the present invention preferably comprises a control release condition determining unit for determining whether the conditions for releasing controls with the controller are satisfied or not.

With the configuration as described above, the working vehicle according to the present invention comprises the control start condition determining unit or the control release condition determining unit, so that reliable controls can be provided without the need for paying attention to the need for starting or releasing the controls for running the vehicle at a constant speed.

The working vehicle according to the present invention should preferably comprise a working machine driven by the engine and an operation detecting unit for detecting operations of the working machine, and the injection rate signal output unit should preferably output an injection rate signal in response to a result of detection by the operation detecting unit.

For instance, when the working machine is directly or indirectly driven with output from the engine, driving the working machine itself requires increase of the engine's duty, which may in turn cause engine stop.

In contrast, the working vehicle according to the present invention comprises the operation detecting unit for detecting operation of the working machine, and outputs an injection signal according to a result of this detection, so that, when a revolution speed of the engine drops due to operations of the working machine, the fuel injection rate of the engine is raised prior to occurrence of engine stop to maintain the revolution speed at the target revolution speed for preventing the engine from stopping.

In the working vehicle according to the present invention, if the working vehicle is a motor grader equipped with a blade, the operation detecting unit is preferably a lifting operation detecting unit for detecting lifting operations of the blade.

In a motor grader, a cutting rate is reduced by making the blade carry out lifting operations during the work for improving a land surface for the purpose to reduce duty of the engine. In the conventional technology, however, even if the blade is raised for reducing the engine's duty, driving the blade itself results in increase of the engine's duty, and sometime engine stop occurs during operations.

Providing a blade lift operation detecting unit in the motor grader is effective for preventing occurrence of engine stop during operations of the blade, and the work for improving a land surface can efficiently be performed.

In the working vehicle according to the present invention, it is preferable that the vehicle is a motor grader.

As descried in description of the background technology, the motor grader performs the work for improving a land surface running at a low speed, and as a high precision is required in the work for improving a land surface, the working machine is required to carry out various types of operations such as a lifting operation of a blade, an operation for circular rotation, and a leaning operation intensively and carefully. Therefore, substantial expertise is required to the operator for running the vehicle at a low speed only with manual operations while carrying out various operations as described above and also for preventing occurrence of engine stop.

When the present invention is applied to a motor grader, it is needless to say that the object of the prevent invention is achieved, and that the work can quickly and precisely be carried out even by unexperienced operators.

DETAILED DESCRIPTION OF PREFERRED EMBODIMENT(S)

An embodiment of the present invention is described below with reference to the related drawings.

Figure 1:
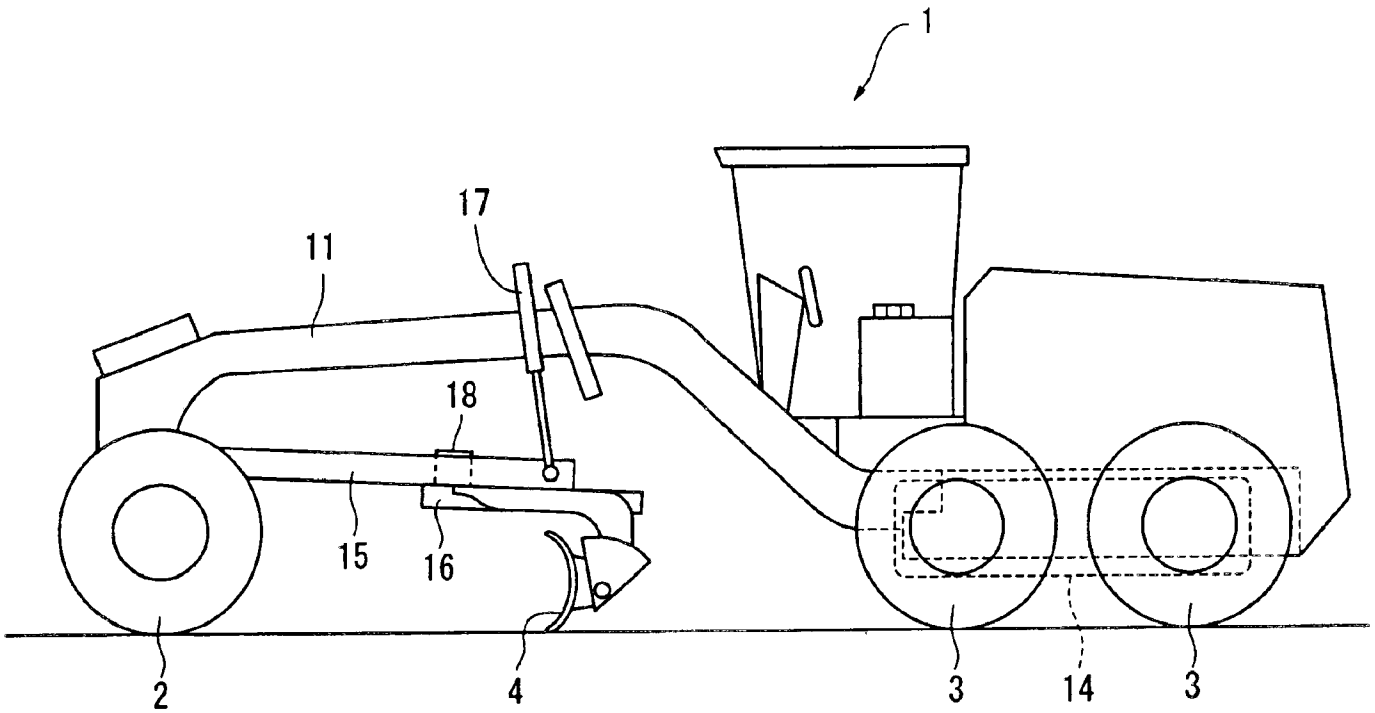
FIG. 1 is a side view showing a working vehicle according to one embodiment of the present invention as a whole.
Figure 2:
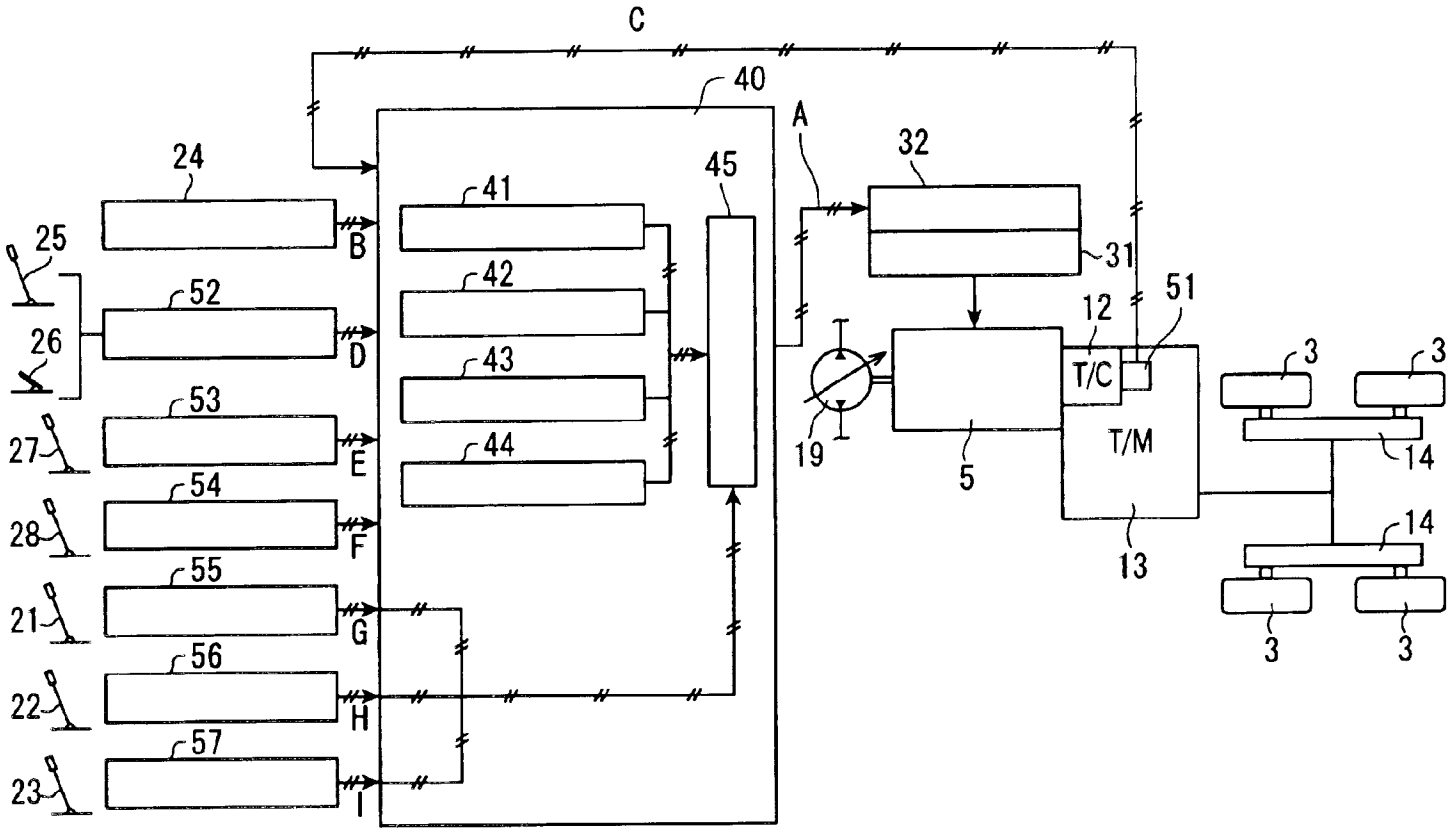
FIG. 2 is a block diagram showing a key section of the working vehicle.

FIG. 1 is a schematic diagram showing a motor grader 1 (working vehicle) according to this embodiment, and FIG. 2 is a block diagram showing a key section of the motor grader 1.

The motor grader 1 comprises front wheels 2 consisting of a pair of right and left wheels (only the left front wheel shown in the figure) and rear wheels 3 consisting of two wheels in the right side and two wheels in the left side (only the rear front wheel in the left side and the rear back wheel in the left side shown in the FIG. 1), and the motor grader can carry out various operations such as works for improving a land surface, removing snow, cutting the ground to some extent, or mixing materials with a blade (working machine) 4 provided between the front wheel 2 and the rear wheel 3. Of the works described above, especially the work for improving a land surface is performed by turning the engine at a low revolution speed and running the vehicle at a low speed, and therefore engine stop easily occurs during this work.

The front wheel 2 is operably provided in the forward side from a frame 11 via a knuckle (not shown), a knuckle support, a front axle, a tie rod, and the like. The front wheel 2 can be inclined in the right and left directions via a leaning mechanism. This leaning mechanism leans the knuckle support to which the front wheel 2 is attached against the front axle, and the leaning operation is performed by expanding or contracting a leaning cylinder provided between the knuckle support and the front frame. The leaning cylinder is expanded and contracted by operating a leaning lever 21 provided in an operation chamber (FIG. 2). This leaning mechanism is effective for making smaller a revolution radius when the motor grader 1 is revolved.

The rear wheel 3 is driven via a torque converter (T/C) 12 connected to one of the output side of a diesel engine 5, a transmission (T/M) 13, a final reducer (not shown), and a tandem device 14.

The blade 4 is attached to a draw bar 15 provided in an area spanning from a front section to a rear section of the frame 11 via a circular circle 16 with inner teeth provided therein, and performs lifting operations by expanding or contracting a lift cylinder 17 with a rear edge of the draw bar 15 hung thereon. This mechanism is a blade lift mechanism, and the lift cylinder 17 is expanded and contracted by operating the lift lever 22 (FIG. 2) provided in an operation chamber.

The circle 16 is rotated and driven by a hydraulic motor 18 attached to the draw bar 15, and the blade 4 can be rotated together with this circle 16. This mechanism is a blade rotation mechanism, and the hydraulic motor 18 is driven by operating a circle lever 23 (shown in FIG. 2) in the operation chamber.

With the configuration described above, supply of a hydraulic pressure to the leaning cylinder, the lift cylinder 17, and the hydraulic motor 18 is performed by a hydraulic pump 19 connected to the other output side of the engine 5 and a control valve not shown herein. Among the various operations performed by the working machine, the lifting operations performed by the blade 4 requires the highest duty of the engine 5, which is another cause for occurrence of engine stop.

In addition, a blade transverse movement mechanism, a blade cutting angle changing mechanism, a draw bar transverse movement mechanism, a scarifier lift mechanism, an articulate angle changing mechanism and others each driven by a hydraulic cylinder or the like may be provided in the motor grader according to the necessity, but these are known mechanisms, so that illustration and detailed description thereof are omitted herefrom.

An injected fuel is fed from an injected fuel injection pump 31 to the engine 5 of the motor grader 1. The injection rate is controlled according to an injection rate signal A outputted from a controller 40 to an electronic governor (injection rate control unit) 32. By controlling the injected fuel injection rate with the controller 40, a revolution speed of the engine 5 is kept constant to keep constant the running speed of the vehicle. Various configurations and various signals used for keeping constant the running speed of the vehicle are described below.

At first, in the engine 3, as revolution speeds for idling, a revolution speed Li for low idling (idling in the low speed area) and a revolution speed Hi for high idling (idling in the high speed area) are set, and an injection rate signal A for either low idling or high idling is outputted from the controller 40 according to a switch signal from a select switch (not shown).

This controller 40 is built by making use of the computer technology. The input signals to the controller 40 include, in addition to the select signal described above, an ON/OFF signal B from a constant running speed control switch 24; an actual revolution speed signal C indicating an actual revolution speed of the engine 5 from a revolution speed sensor (revolution speed detecting unit 51) provided in the output side of the torque converter 12; an accelerator position signal D from an accelerator position detecting unit 52 for detecting operating positions of an accelerator lever 25 and an accelerator pedal 26 mechanically connected to each other; a brake operation signal E from a brake operation detecting unit 53 provided, for instance, on the brake lever 27; a shift position signal F from a shift position detecting unit 54 for detecting an operating position of a T/M shift lever 28; a leaning operation signal G from a leaning operation detecting unit 55 of the leaning lever 21; a lift operation signal H from a lift operation detecting unit 56 of the lift lever 22; and a circle operation signal I from a circle operation detecting unit 57 of the circle lever 23.

Various types of sensors capable of detecting a position of each lever or the fact that each of the levers is operated may be used as the detecting units 52 to 56.

The controller 40 reads out each of the program units each comprising a computer program (software) from a storage unit (not shown) and runs the program to provide controls for running the vehicle at a constant speed. Namely the program units read out by the controller 40 include a target revolution speed setting program unit 41, a control start condition determination program unit 42, a control release condition determination program unit 43, a revolution speed comparison program unit 44, and an injection rate signal output program unit 45.

The target revolution speed setting program unit 41. has the function to automatically decide a target revolution speed N3 of the engine 5 according to the actual revolution speed signal C from the revolution speed sensor 51 generated when the constant running speed control switch 24 is turned ON. In this embodiment, when it is determined based on the actual revolution speed signal C that the engine 5 is revolving at the actual revolution speed N1, if the actual revolution speed 1 is the same as the revolution speed Li for low idling, a value obtained by subtracting a prespecified revolution speed ΔN2 from this actual revolution speed N1 (which is equal to the revolution speed Li for low idling) is set as a target revolution speed N3 (N3=N1−ΔN2). On the other hand, when the detected actual revolution speed N1 is higher than the revolution speed Li for low idling, the actual revolution speed N1 is set as the target revolution speed N3 (N3=N1) as it is.

The control start condition determination program unit 42 determines whether the motor grader 1 is now ready for providing controls for running the vehicle at a constant speed or not, and when it is determined that the motor grader 1 is ready for it, the control start condition determination program unit 42 starts providing the controls. More specifically, the control start condition determination program unit 42 monitors the ON/OFF signal B from the constant running speed control switch 24; the actual revolution speed signal C from the revolution speed sensor 51; a brake operation signal E from the brake operation detecting unit 54; and the shift position signal F from the shift position detecting unit 53, and when it is determined upon receipt of the ON/OFF signal B that the constant running speed control switch 24 is ON, upon receipt of the actual revolution speed signal C that the engine 5 is driving, upon receipt of the brake operation signal E that the braking operation is now not being effected, and upon receipt of the shift signal F that the T/M shift lever 28 is at a position other than neutral and parking, in other words, when all of these conditions are satisfied, provision of the controls for running the vehicle at a constant speed is started.

The control release conditions determination program unit 43 determines whether the operation for releasing the controls for running the vehicle at a constant speed had been performed or not, and when it is determined that the operation for releasing the controls has been done, it releases the controls for running the vehicle at a constant speed. More specifically the control release conditions determination program unit 43 monitors the ON/OFF signal B from the constant running speed control switch 24; the accelerator position signal D from the accelerator position detecting unit 52; the brake operation signal E from the brake operation detecting unit 53; and the shift position signal F from the shift position detecting unit 54, and when it is determined upon receipt of the ON/OFF signal B that the constant running speed control switch 24 is OFF, or upon receipt of the accelerator position signal D that the accelerator lever 25 or the accelerator pedal 26 has been operated, or upon receipt of the brake operation signal E that the brake operation has been done, or upon receipt of the shift position signal F that the T/M shift lever 28 is at a position other than neutral or parking, in other words, when any one of the conditions above is satisfied, the controls for running the vehicle at a constant speed are released.

The revolution speed comparison program unit 44 monitors the actual revolution speed signal C from the revolution sensor 51 while the controls for running the vehicle at a constant speed are being provided, compares the actual revolution speed N of the engine 5 to the target revolution speed N3, and outputs a result of this comparison to the injection rate signal output program unit 45.

When it is determined based on the result of comparison by the revolution speed comparison program unit 44 that the actual revolution speed N is lower than the target revolution speed N3, the injection rate signal output program unit 45 continuously outputs the injection rate signal A to the electronic governor 32 to instruct increase of the feed rate of the injected fuel until the actual revolution speed N becomes higher to reach the target revolution speed N3. On the contrary, when it is determined based on the result of comparison by the revolution speed comparison program unit 44 that the actual revolution speed N is higher than the target revolution speed N3, the injection rate signal output program unit 45 continuously outputs the injection rate signal A to the electronic governor 32 to instruct decrease of the feed rate of the injected fuel until the actual revolution speed N becomes lower than the target revolution speed N3. With the controls described above, the actual revolution speed N is always fed back to the controller 40, so that the revolution speed of the engine 5 is always kept at the target revolution speed N3 and the vehicle is run at a constant speed.

In addition, this injection rate signal output program unit 45 monitors the leaning operation signal G from the leaning operation detecting unit 55; the lift operation signal H from the lift operation detecting unit 56; and the circle operation signal I from the circle operation detecting unit 57, and when it is determined upon receipt of the operation signals G, H, I that each of the levers 21, 22, 23 has been operated, the injection rate signal output program unit 45 outputs the injection rate signal A to instruct increase of the jet injected fuel feed rate to the electronic governor 32. With this operation, when the leaning cylinder, lift cylinder 17, and hydraulic motor 18 are driven and the revolution speed of the engine 5 is just to sharply drop, it is possible to increase the injected fuel feed rate to maintain the actual revolution speed N at the target revolution speed N3 for preventing occurrence of engine stop.

Figure 3:
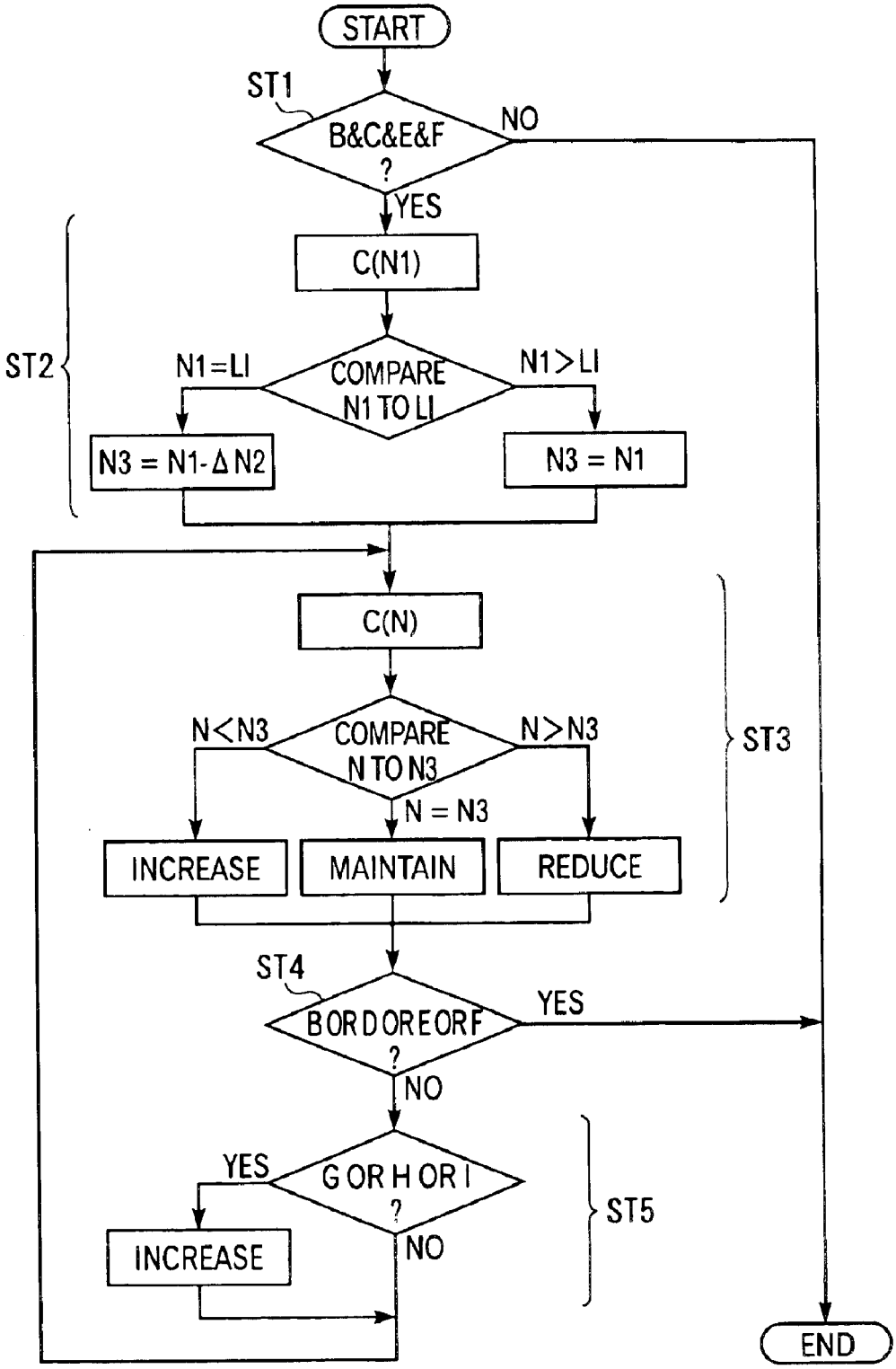
FIG. 3 is a flow chart for illustrating a control for making a vehicle run at a constant speed.

The controls for running the vehicle at a constant speed are described in further details below with reference to the flow chart in FIG. 3.

Step (described as ST hereinafter) 1: In this control, when the operator wants to start controls for running the vehicle at a constant speed, the operator at first pressed the constant running control switch 24. Then the control start condition determining program unit 42 is booted in the controller 40 to start detection of the ON/OFF signal B, actual revolution speed signal C, brake operation signal E, and shift position signal F.

When it is determined based on any of the input signals B, C, E, and F that the conditions for starting the controls for running the vehicle at a constant speed are not satisfied, the control start conditions determining unit 42 does not start providing the controls for running the vehicle at a constant speed, and terminates the operation immediately. In other words, the controls for running the vehicle at a constant speed are not started in this case. Further the reason why the controls are not started such as that "The T/M shift lever 28 is at the neutral position" is displayed on a display unit on an operation panel not shown. On the other hand, when it is determined that all of the signals B, C, E, and F satisfy the conditions for starting the controls for running the vehicle at a constant speed, the control start condition determining unit 42 starts providing the controls for running the vehicle at a constant speed, and goes to ST2.

ST2: In this step, the revolution speed setting program unit 41 starts, and at first detects the actual revolution speed N1 of the engine 5 at the current point of time from the actual revolution speed signal C. Then, the actual revolution speed N1 is compared to the revolution speed Li for low idling, and when the actual revolution speed N1 is higher than the revolution speed Li for low idling (N1>Li), the actual revolution speed N1 is set as the target revolution speed N3 as it is, and is stored in a storage device. When the actual revolution speed N1 is equal to the revolution speed Li for low idling (NI=Li), a value obtained by subtracting a prespecified revolution speed ΔN2 from the actual revolution speed N1 is set as the target revolution speed N3 and is stored in the storage device. Although not shown in the figure, when it is determined that the actual revolution speed N1 is not more than the revolution speed Li for low idling (N1≦Li) for any reason, a value obtained by subtracting the prespecified revolution speed ΔN2 from the actual revolution speed N1 may be set and stored as the target revolution speed N3.

ST3: Then the revolution speed comparison program unit 44 and the injection rate signal output program unit 45 are booted. Again in this step, the actual revolution speed N is detected from the actual revolution speed signal C. Then the actual revolution speed N of the engine is compared to the target revolution speed N3.

As a result of this comparison, when it is determined that the actual revolution speed N is higher than the target revolution speed N3 (N>N3), the feed rate of the injected fuel is reduced to drop the revolution speed of the engine 5. The injected fuel feed rate is reduced until the actual revolution speed N is equalized to the target revolution speed N3 (N=N3), and when the N is equalized to N3, the feed rate is maintained at the constant level.

When it is determined that the actual revolution speed N is smaller than the target revolution speed N3 (N<N3), the injected fuel feed rate is increased to raise the revolution speed of the engine 5. The injected fuel feed rate is increased until the actual revolution speed N becomes equal to the target revolution speed N3 (N equalized to N3), and when N becomes equal to N3, the feed rate is maintained at the constant level.

In this step, if a value obtained by subtracting the prespecified revolution speed ΔN2 from the actual revolution speed N1 is set as the target revolution speed N3, in other words, if the target revolution speed N3 is lower than the revolution speed Li for low idling, the motor grader 1 performs the work for improving a land surface or the like in this state. In this state, when an ascending slope of the land to be improved becomes sharper during the work for improving the land surface, or when the cutting rate temporally increases and a higher duty is required for the engine 5 with the actual revolution speed N of the engine 5 dropped, the injected fuel feed rate is increased to raise the actual revolution speed N to the target revolution speed N3 for the purpose to prevent occurrence of engine stop.

On the other hand, when the target revolution speed N3 is equal to the actual revolution speed N1, namely when the target revolution speed N3 is higher than the revolution speed Li for low idling, for instance, high speed running at a constant speed can be realized by maintaining the actual revolution speed N at the target revolution speed N3.

ST4: During the operations for providing the controls for running the vehicle at a constant speed, the control release conditions determination program unit 43 monitors the in-coming signals B, D, E, and F. During the operations, when the conditions for releasing the controls for running the vehicle at a constant speed are satisfied, the control release conditions determination program unit 43 releases the controls for running the vehicle at a constant speed, and then terminates the operation. This operation is performed, for instance, when the constant running control switch 24 is again pressed during the controls for running the vehicle at a constant speed, and when the ON/OFF signal B indicates the OFF state.

ST5: Further during the controls for running the vehicle at a constant speed, the injection rate signal output program unit 45 monitors input of the operation signals G, H, and I. When any of the levers 21, 22, 23 for any of the leaning mechanism, blade lift mechanism, and blade circling mechanism is operated and any of the operation signals G, H, and I comes in, the injected fuel feed rate is made higher immediately. With this operation, even when the blade 4 is being lifted or circled, the actual revolution speed N of the engine 5 does not drop sharply and occurrence of engine stop is prevented.

If the operation signals C, H, I continuously come in like in the case when the blade 4 is operated continuously, it is considered that the injected fuel feed rate continuously increases and also the actual revolution speed continuously becomes higher and higher. However, as the actual revolution speed N is adjusted to the target revolution speed N3 when the control flow returns to ST3, the actual revolution speed N will never largely surpasses the target revolution speed N3, so that the running speed never becomes excessively higher.

There is not any specific restriction over the order of ST4 and ST5, and the reverse order is allowable.

With this embodiment of the present invention, the advantages as described below are provided.

(1) In the motor grader 1, for instance, when the work for improving a land surface with the blade 4 is to be started by making the vehicle start running at a low speed from the low idling state, the controls for running the vehicle at a constant speed may immediately be started. With this feature, by maintaining the actual revolution speed N of the engine 5 at the target revolution speed N3 which is lower by the prespecified revolution speed ΔN2 than the revolution speed Li for low idling to make the vehicle run at the constant speed, the work for improving a land surface can be performed. Therefore, even in the case where the duty of the engine 5 increases and the actual revolution speed N sharply drops like in the situation when an ascending slope of the land to be surfaced becomes larger or the cutting rate temporally increases due to local irregularities of the land surface to be improved during the work for improving the land surface, it is possible to continue the work running the vehicle at a constant speed by immediately returning the actual revolution speed N to the target revolution speed N3, and occurrence of engine stop can be prevented during the work at a low speed without fail.

(2) As occurrence of engine stop can be prevented during the work for improving a land surface, formation of a step on the land surface to be improved can be prevented. And high precision in land surface improvement can be preserved, which eliminates the need for restarting the work from the beginning and substantially improves the work efficiency. In addition, as the running speed is controlled at a low speed, the operator can concentrate his or her attention to such works as the leaning operation, the operation for lifting the blade 4, and the circle operation, and also in this point, the improved precision in the land surface improvement work and the improved work efficiency can be expected, and further the work can quickly be carried out with high precision.

(3) As the target revolution speed N3 in the low speed area as described above is automatically read out by the target revolution speed setting program unit 41 based on the actual revolution speed N1 detected immediately when provision of the controls for running the vehicle at a constant speed is started and the revolution speed Li for low idling previously stored in a storage unit, it is not necessary to previously store the target revolution speed N3 itself, which varies according to a type of a model or other parameters of the engine 5, for each motor grader 1, which in turn reduces the work load for setting the target revolution speed N3 for each vehicle.

(4) On the other hand, if the actual revolution speed N1 of the engine 5 is higher than the revolution speed Li for low idling like in the case where the vehicle only runs without driving the blade 4 or any other working machine, the actual revolution speed N1 when the vehicle is running is used as the target revolution speed N3 as it is by providing the controls for running the vehicle at a constant speed and making the target revolution speed setting program unit 41 work, so that the vehicle can be run at a constant running speed without operating the accelerator.

(5) The controller 40 comprises the control start condition determination program unit 42 and the control release condition determination program unit 43, so that highly reliable control can be realized without committing the risk of unexpectedly starting or releasing the controls for running the vehicle at a constant speed ignoring the operating state of the engine 5, a position of the T/M shift lever 28, or other related factors.

(6) The injection rate signal output program unit 45 outputs the injection rate signal A according to a result of detection by the leaning operation detecting unit 55, lifting operation detecting unit 56, and the circle operation detecting unit 57, so that, even when the leaning cylinder, shift cylinder 17, and the hydraulic motor 18 are started during the controls for running the vehicle at a constant speed in the low speed area and the duty of the engine 5 suddenly increases with the actual revolution speed N dropped, it is possible to maintain the actual revolution speed N at the target revolution speed N3 by raising the injected fuel feed rate to prevent the revolution speed from dropping, and also in this point occurrence of engine stop can be prevented without fail.

(7) In the motor grader 1, when the lift cylinder 17 is expanded or contracted for lifting operations of the blade 4, the duty of the engine 5 becomes substantially larger, and in the conventional technology, the actual revolution speed N sharply drops and engine stop occurs. In this embodiment, however, even when the injected fuel feed rate is raised and the lift operation associated with the risk of occurrence of engine stop is frequently repeated, occurrence of engine stop can be prevented without fail, so that the performance of the motor grader 1 can substantially be improved.

(8) Further, as the actual revolution speed N is maintained at the target revolution speed N3 by controlling the injected fuel feed rate to the engine 5 to maintain the revolution speed at a constant value in the low speed area, it is not necessary to scale up the engine 5 for preventing occurrence of engine stop by making use of the torque in the low speed area, and therefore a high revolution speed type of engine with the relatively small size can be used as the engine 5. For this reason, the space requires for mounting the engine on the vehicle may be small, which allows further size reduction of the motor grader 1. Further discharge of fuel not burned or particulates can be suppressed more as compared to a large engine making use of torque in the low speed side, so that the cleaner exhaust gas can be discharged.

It is to be noted that the present invention is not limited to the embodiment described above, and other configurations or components available for achieving the objects of the present invention are included within the scope of the present invention, and also the following variants are included within the scope of the present invention.

In the present embodiment, for instance, even when any of the leaning operation, the operation for lifting the blade 4, and the circle operation is being performed, the jet fuel feed rate is increased, but in addition, also when any of the operations as the operation for moving the blade in the sideward direction, the operation for changing a cutting angle of the blade, the operation for moving the draw bar in the sideward direction, the scarifier lifting operation, and the operation for changing an angle of the articulate is performed by making use of output from the engine 5, the jet fuel feed rage may be raised.

It is to be noted that, even if the controls as described above are not provided, the embodiment is included within the scope of the present invention excluding claim 5.

In the embodiment described above, when the controls for running the vehicle at a constant speed in the low speed area are to be provided, the target revolution speed N3 is calculated by subtracting the prespecified revolution speed ΔN2 from the actual revolution speed N1, but the target revolution speed N3 may be calculated by multiplying the actual revolution speed N1 by a prespecified percentage (%).

Further the configuration is allowable in which the target revolution speed N3 is not calculated with, for instance, the target revolution speed setting program unit 41 or the like, and the revolution speed is previously specified and stored in a storage device. However, by computing the target revolution speed N3, the effects as described in (3) above can be achieved, so that the configuration according to the present invention is preferable.

Description of the embodiment described above assumes the case where controls are provided for making the vehicle run at a constant speed by setting the actual revolution speed N1 at the target revolution speed N3 (running without performing the work concurrently), but when it is required to run the engine at a revolution speed higher than the revolution speed Li for low idling, it is needless to say that the controls for running the vehicle at a constant speed as described above may be provided even during the work.

The electronic governor 32 is used as the injection rate control unit according to the present invention in the embodiment described above, a mechanical governor and a pulse motor (governor motor) for driving the mechanical governor may be used.

The working vehicle according to the present invention is not limited to the motor grader 1, and the present invention can be applied also to any type of civil engineering machines or construction machines which perform works maintaining the running speed at a low value.

What is claimed is:

1. A working vehicle for carrying out work at a low running speed, said working vehicle comprising:

an engine to provide a driving force;

a fuel injection pump for feeding fuel to the engine;

an injection rate control unit for controlling a fuel feed rate from the fuel injection pump to the engine;

a revolution speed detecting unit for detecting an actual revolution speed of the engine; and a controller for adjusting a running speed by controlling a revolution speed of the engine to a target revolution speed according to the actual revolution speed detected by the revolution speed detecting unit, wherein the controller comprises:

a revolution speed comparison program unit for comparing the actual revolution speed to the target revolution speed; and an injection rate signal output program unit for outputting an injection rate signal corresponding to a result of comparison in the revolution speed comparison program unit to the injection rate control unit; and a target revolution speed setting program unit for calculating and setting the target revolution speed based on the actual revolution speed detected by the revolution speed detecting unit, such that when the actual revolution speed is equal to a revolution speed for idling in a low speed area, the target revolution speed setting program unit sets the target revolution speed by subtracting a prespecified revolution speed from the actual revolution speed.

2. The working vehicle according to claim 1, wherein when the actual revolution speed is greater than a revolution speed for idling in a low speed area, the target revolution speed setting program unit sets the actual revolution speed as the target revolution speed.

3. The working vehicle according to claim 1, further comprising a control start condition determination program unit for determining whether conditions for starting the controlling by the controller are satisfied.

4. The working vehicle according to claim 1, further comprising a control release condition determining program unit for determining whether the conditions for stopping the controlling by the controller are satisfied.

5. The working vehicle according to claim 1, further comprising;

a working machine driven by the engine; and an operation detecting unit for detecting operations of the working machine, wherein the injection rate signal output program unit outputs the injection rate signal in response to a result of determination by the operation detecting unit.

6. The working vehicle according to claim 5, wherein, the working vehicle is a motor grader, the working machine comprises a blade, and the operation detecting unit comprises a lifting operation detecting unit for detecting a lifting operation of the blade.

7. The working vehicle according to claim 1, wherein the working vehicle is a motor grader.

* * * * *